US005711187A

United States Patent [19]

Cole et al.

[11] Patent Number: 5,711,187

[45] Date of Patent: Jan. 27, 1998

[54] GEAR WHEELS ROLLED FROM POWDER METAL BLANKS AND METHOD OF MANUFACTURE

[75] Inventors: Christopher John Cole, Gloucester, Great Britain; Rohith Shivanath; Peter Jones, both of Toronto, Canada

[73] Assignee: Formflo Ltd., England

[21] Appl. No.: 368,080

[22] Filed: Jan. 3, 1995

Related U.S. Application Data

[63] Continuation of Ser. No. 853,708, Jun. 5, 1992, abandoned.

[30] Foreign Application Priority Data

Oct. 8, 1990 [GB] United Kingdom ..... 9021833

[51] Int. Cl.[6] ..... F16H 55/17; B21D 53/28

[52] U.S. Cl. ..... 74/434; 74/460; 29/893.32; 29/893.36; 29/893.37

[58] Field of Search ..... 29/893.32, 893.34, 29/893.37, 893.36; 74/434, 460

[56] References Cited

U.S. PATENT DOCUMENTS

| | | |
|---|---|---|
| 3,738,140 | 6/1973 | Motz et al. . |
| 3,877,273 | 4/1975 | Culver . |
| 4,059,879 | 11/1977 | Chmura et al. . |
| 4,251,273 | 2/1981 | Smith et al. . |
| 4,394,421 | 7/1983 | Chmura et al. . |
| 4,708,912 | 11/1987 | Huppmann . |
| 4,885,133 | 12/1989 | Fujii . |
| 4,913,739 | 4/1990 | Thümmler et al. . |
| 4,966,626 | 10/1990 | Fujiki et al. . |
| 5,108,493 | 4/1992 | Causton . |
| 5,154,881 | 10/1992 | Rutz et al. . |
| 5,217,683 | 6/1993 | Causton . |

FOREIGN PATENT DOCUMENTS

| | | |
|---|---|---|
| 0 371 340 | 6/1990 | European Pat. Off. . |
| 1340775 | 9/1963 | France . |
| 2138554 | 5/1990 | Japan . |
| 1125952 | 9/1968 | United Kingdom . |
| 1377066 | 12/1974 | United Kingdom . |
| 1384388 | 2/1975 | United Kingdom . |
| 1532641 | 11/1978 | United Kingdom . |
| WO 94/05822 | 3/1994 | WIPO . |

OTHER PUBLICATIONS

International Search Report, PCT/GB 91/01742, Jan. 31, 1992.

Dixon, R.H.T. and Clayton, A., *Powder Metallurgy for Engineers*, The Machinery Publishing Company, Ltd., Brighton, Sussex, England, 1971, Chapter 3, pp. 30–57.

Poster, A. R., *Handbook of Metal Powders*, Reinhold Publishing Corporation, N.Y., Section 11, "Data on Commercially Available Metal Powders".

*Powder Metallurgy Design Manual*, Metal Powder Industries Federation, 1989, pp. 50–56.

Hoeganaes Corporation, *Ancorsteel 1000, 1000B, 1000C*; Apr., 1990 (4.90), pp. 1–19.

*Primary Examiner*—P. W. Echols

*Attorney, Agent, or Firm*—Pollock, Vande Sande & Priddy

[57] ABSTRACT

A gear wheel is formed from a pressed and sintered powder metal blank in which the metal powder comprises an admixture of iron powder and at least one alloying addition and the gear wheel is surface hardened by densifying at least the tooth root and flank regions to establish densification in the range of 90 to 100 percent of full theoretical density to a depth of at least 380 and up to about 1,000 microns.

22 Claims, 3 Drawing Sheets

GEAR WHEELS ROLLED FROM POWDER METAL BLANKS AND METHOD OF MANUFACTURE

This is a Continuation of application Ser. No. 07/853,708, filed Jun. 5, 1992 now abandoned, national stage filing of PCT/GB91/01742 of 8 Oct. 1991, the entire disclosure of which is incorporated herein by reference.

This invention relates to a method of producing gear wheels from powder metal blanks. The invention is particularly concerned with achieving a degree of surface hardness which enables such gear wheels to be sufficiently wear resistant for use in heavy duty applications. Particular applications contemplated are for power transmission such as in vehicle gear boxes where high loading and speeds must be accommodated.

Gears formed from sintered powder metal blanks are well known. British Patent Specification No. 1125952 discloses a method of producing gear wheels from powder metal blanks in which, after pressing the powder and sintering, the gear wheel is rolled to properly size the teeth and teeth root diameters. The manufacture of both spur and helical gears is contemplated.

A primary problem with gear wheels formed from powder metal blanks is that when compared with gears machined from bar stock, castings or forgings, powder metal gear wheels have reduced bending fatigue strength in the tooth root region, and low wear resistance on the tooth flanks due to the residual porosity in the microstructure. For these reasons, while powder metal gear wheels can be used in low stress applications such as oil pumps, they were not suitable for power transmission. As power transmission applications use predominantly helical gears, there has been very little use of helical gears made from powder metal blanks in highly loaded transmission applications.

We have found that substantial improvements in the bending strength and wear resistance of gears in powder metal gear wheels can be achieved if sufficient densification of the gear surface, and to sufficient depths, is established. According to the invention, a gear wheel formed from a pressed and sintered powder metal blank is surface hardened by rolling in the tooth root and flank regions to establish densification in the range of 90 to 100 percent to a depth of at least 380 microns. The core density; ie below the densified regions, is Usually substantially uniform, typically at around 90 percent of full theoretical density of the material. Normally the depth of densification is in the range 380 to 500 microns. We have found that little additional benefit is achieved if the depth of densification exceeds 1000 microns. The density at the surface is substantially 100% of full theoretical density, and remains at a density no less than 90% of full theoretical density at least to the minimum depth specified. The rate at which the density reduces with respect to depth is normally at least linear; ie, the minimum density in the hardened regions is inversely proportional to the depth. Usually, the density at least in regions closer to the surface will be significantly greater than this minimum value. Typically, the rate of density reduction will be very low at the surface and increase uniformly towards the maximum depth of the hardened regions. Thus the density might vary in relation to the square or a higher power of the depth.

The metal powders used in gears according to the invention will be selected according to the eventual application, and can include low alloy steel grades similar to those used in the manufacture of high performance gears from other forms of metal. The powders can be either admixed elemental iron plus alloying additions, or fully pre-alloyed powders. Typical fully pre-alloyed powders would be of a composition such as AISI 4600 and its derivatives. Admixed powders have the advantage of being more compressible, enabling higher densities to be reached at the compaction stage. In addition, the use of admixed powders enables compositions to be tailored to specific applications. For example, elemental powders may be blended together with a lubricant to produce, on sintering, low alloy gears of compositions similar to SAE 4100, SAE 4600, and SAE 8600 grades. Elemental powder additions to the base iron can include Carbon, Chromium, Molybdenum, Manganese, Nickel, Copper, and Vanadium. Again, quantities of the additives will vary with different applications, but will normally be no more than 5 percent by weight in each case.

A preferred admixed powder composition in gears according to the invention has the following composition by weight:

| | |
|---|---|
| Carbon | 0.2% |
| Chromium | 0.5% |
| Manganese | 0.5% |
| Molybdenum | 0.5% |

the balance being iron and unavoidable impurities.

It will be recognised that the use of Chromium, Molybdenum and Manganese in the formation of a sintered powder metal blank requires a sintering process which can minimise their oxidation. A preferred process used in this invention is to sinter at high temperature up to 1350° C. in a very dry Hydrogen/Nitrogen atmosphere, for example at a dew point of –40° C. This has the additional benefit of further improving mechanical properties and reducing oxygen levels to approximately 200 ppm.

The alloying addition powders used in gears according to the invention will preferably have a particle size in the range 2 to 10 microns. Generally, particle sizes in this range can be achieved by fine grinding of ferroalloys in an appropriate inert atmosphere. Prevention of oxidation of readily oxidisable alloying powders at the grinding stage can be critical to the achievement of the degrees of densification referred to above.

Densification of the operative surface layer of a powder metal gear as specified above may be accomplished in a number of rolling techniques. These may employ either a single die or twin die rolling machine, and may include separate and/or simultaneous root and flank rolling. In each case, the or each rolling die is normally in the form of a mating gear made from hardened tool steel. In use, the die is engaged with the sintered gear blank, and as the two are rotated their axes are brought together to compact and roll the selected areas of the blank surface. For example, the die(s) and blank may be mounted in the rolling machine on axles which move toward one another to increase the penetration or rolling depth of the die(s). When a predetermined axle spacing has been reached, rotation at that spacing will usually continue for a given number of gear revolutions, or dwell time, and then the two parts will be withdrawn from one another. The predetermined axle spacing will of course depend on the size of the gear and die as well as the material of the blank and the desired densification. Typically, the respective rolled surface will be compacted by around 120 microns.

Some rolling techniques embodying the invention will now be described by way of example, and with reference to the accompanying schematic drawings wherein.

and

Figure 3:
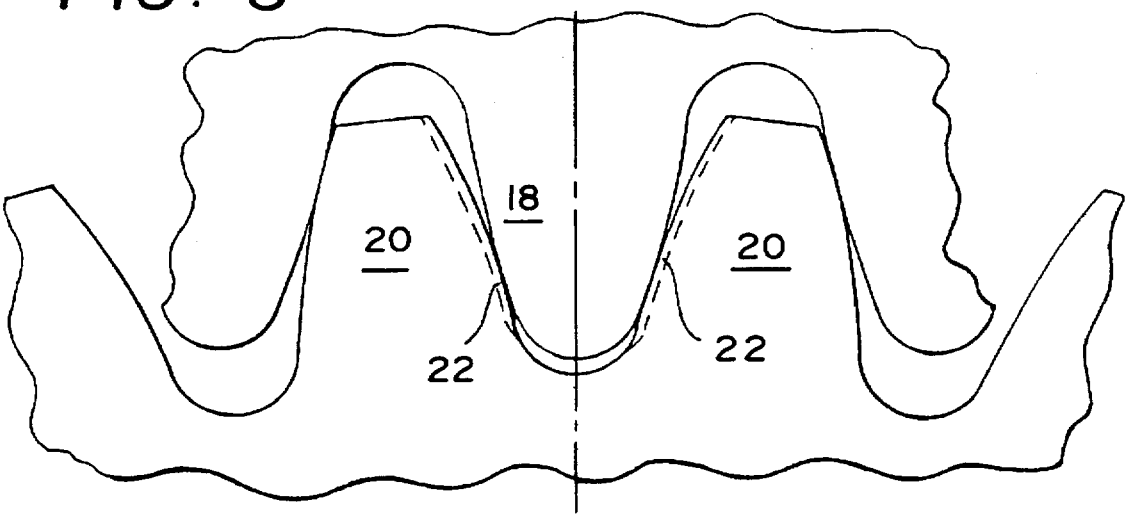
Figure 4:
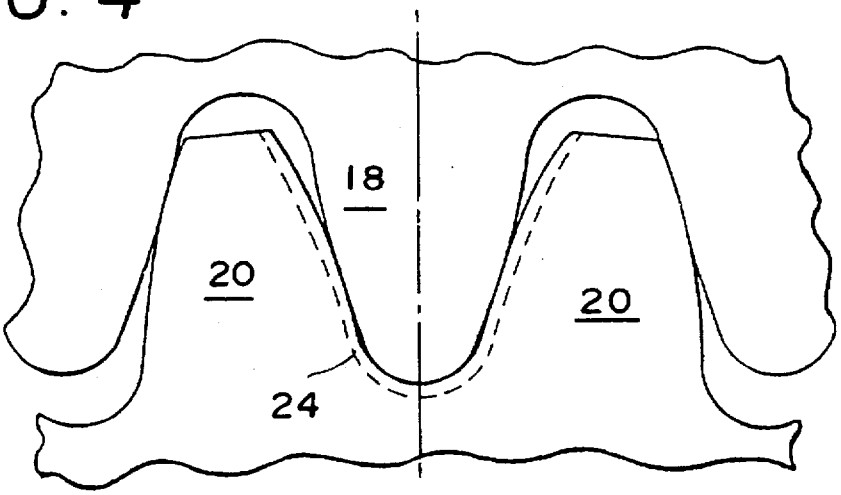
Figure 5:
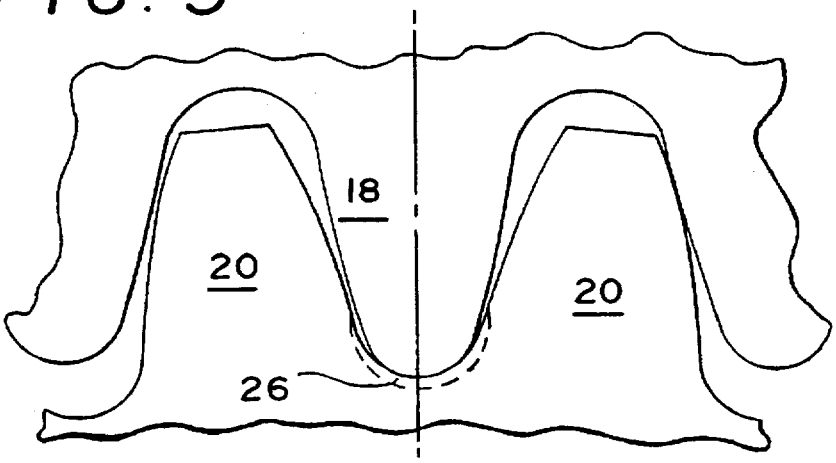

FIGS. 3 to 5 are detailed views showing different die geometries used for different rolling functions.

Figure 1:
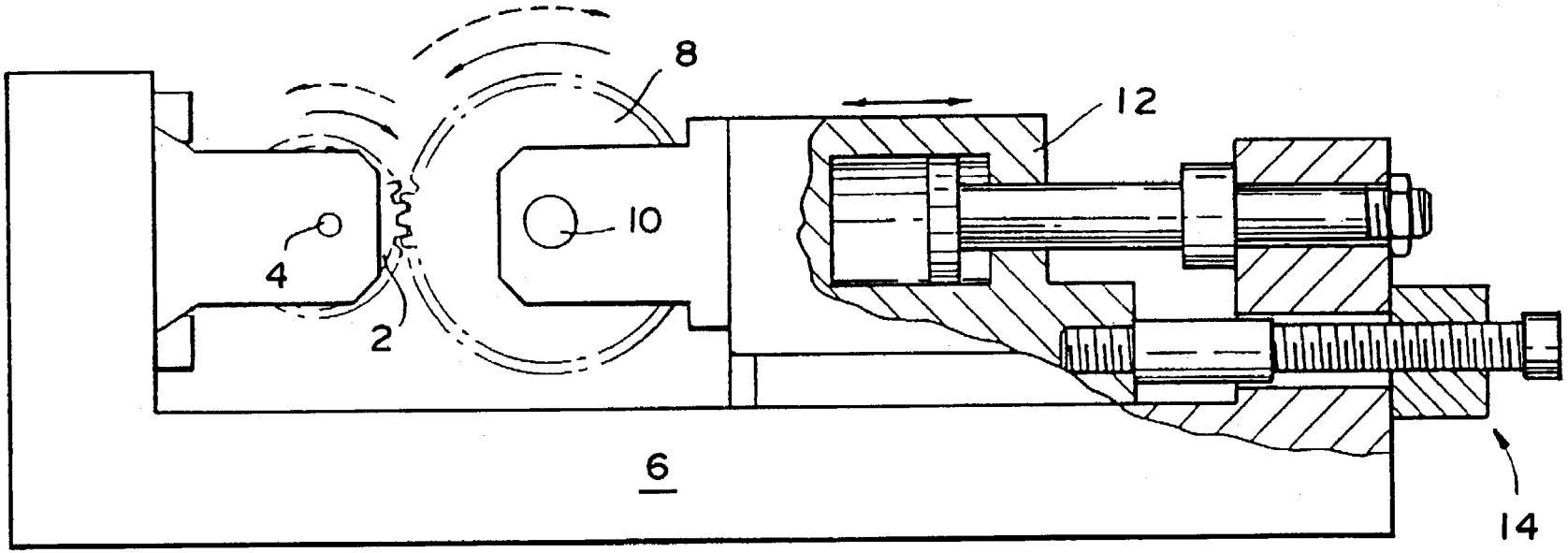
FIG. 1 is a partially broken side elevation of a single die rolling machine.

In the rolling machine of FIG. 1 the powder metal blank 2 is showed mounted on a fixed axle 4, itself supported on a frame 6. A die 8 is rotatably mounted on an axle 10 supported on a carriage 12 which is slidably mounted on the frame 6. The carriage 12 is movable on the frame 6 towards and away from the axle 4 to bring the die 8 into and out of engagement with the alloy metal blank 2. Such movement is imparted to the carriage 12 by a mechanism, details of which are omitted. The carriage 12 is constrained to move relative to the frame 6 along a linear path, and the degree of permitted advance is limited by a stop 14. Also mounted on the carriage 12 is a drive mechanism (not shown) for rotating the die 8 upon the axle 10. The drive mechanism may comprise a simple motor coupled to an appropriate wheel for engaging the teeth of the die. For reasons which will be explained below: the drive mechanism should be operable to rotate the die 8 in both senses.

In conducting of the process according to the invention with the machine of FIG. 1, the powder metal blank is mounted on the axle 4, and the appropriate die mounted on the axle 10, and suitably coupled to the drive mechanism. The carriage 12 is advanced to engage the teeth of the die with the teeth of the blank, and the drive mechanism is actuated to rotate both the die and the blank in mesh with one another. As the die and blank rotate, the carriage continues to advance and the teeth of the die 8 roll and densify the respective surfaces of the blank 2 with which they are in contact. The carriage advances up to a full depth position defined by the stop 14. Rolling continues at this depth for a predetermined period of time or number of revolutions of the blank, and the carriage is then withdrawn with the die and blank still rotating.

During the rolling processes above described, the rotation of the die and blank may be reversed on a number of occasions. Intermittent reversal throughout the process may be appropriate, and the frequency of such reversals can be set by numbers of rotations of the die or the blank.

Figure 2:
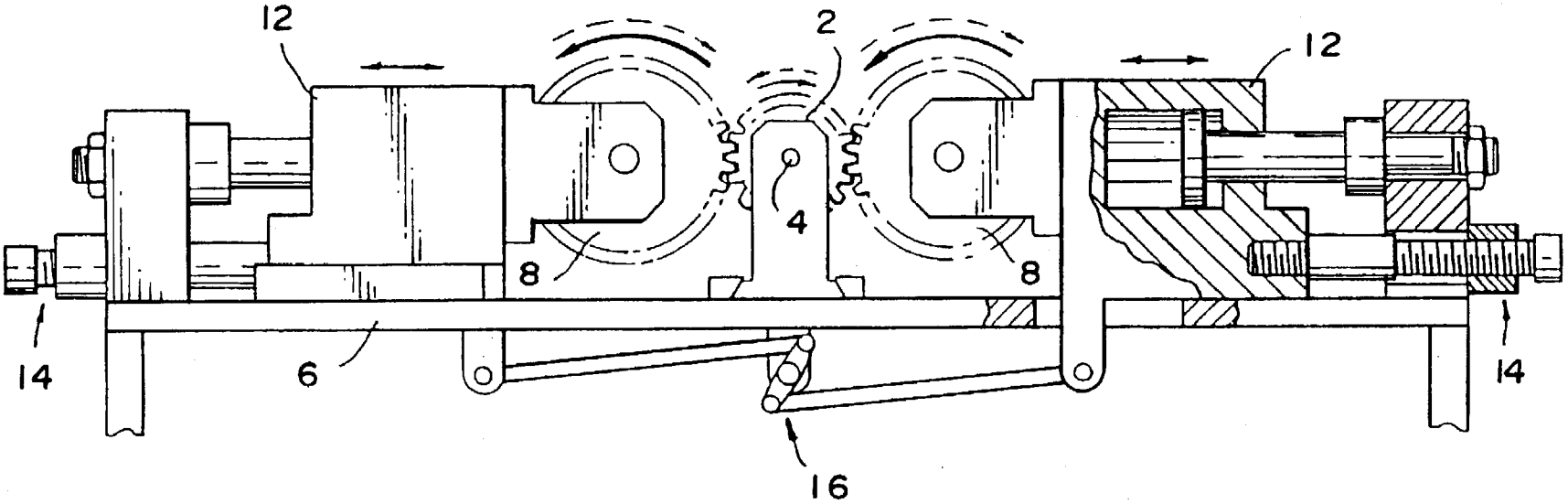
FIG. 2 is a partially broken side elevation of a twin die rolling machine.

The machine of FIG. 2 operates in a manner substantially similar to that of FIG. 1, and corresponding parts are similarly identified. Essentially, the machine of FIG. 2 has a pair of dies 8 operating simultaneously on the same blank 2. Advance and retraction of the carriages 12 is synchronised by means of a simple lever system 16. In other respects the same criteria may be adopted as are described above with reference to FIG. 1. Additionally of course, the rotation of the dies 8 must be synchronised. Although it is possible to use only a single drive mechanism coupled to one of the dies, it is normally preferred to use two, synchronised electronically.

As noted above, in rolling a powder metal gear blank in accordance with the invention, a number of different types of rolling can be achieved depending upon the profile of the blank and die or dies, and the type of rolling required. Primarily, it is the roots and the flanks of the gear teeth that must be rolled to obtain the surface densification required to achieve the performance improvements discussed above. In FIGS. 3 to 5, the same blank profile is shown. Dies having different teeth profiles are used to effect rolling on different portions of the surfaces of the blank teeth.

In FIG. 3, flank rolling only is illustrated. As the dies and blank of FIG. 1 or 2 rotate together, the flanks of the die teeth 18 roll and wipe against the flanks of the blank teeth 20 as the carriage or carriages 12 advance towards the blank axis. As a consequence, the material at the surface of the flanks of the blank teeth 20 is compacted to form the densified layer 22. It will be noted that at no time does the tip of a die tooth 18 engage the root of the blank teeth 20. This is ensured by the stop 14. The profiles of the die teeth 18 and the blank teeth 20 are selected to ensure that no such contact is made while nevertheless achieving the desired compaction in the regions 22.

In FIG. 4, the profile of the die teeth is altered such that rolling is effected simultaneously at the root and on the flank of the blank teeth. This results in a continuous compacted region 24 which extends between the tips of adjacent blank teeth as shown.

In FIG. 5, another alternative profile for the die teeth is chosen to achieve root rolling only. In this case, the compacted region 26 is much more restricted than in either of the variants of FIGS. 3 and 4.

It will be appreciated from the above description of FIGS. 3 to 5 that different areas of compaction can be established on and between the teeth of a powder metal blank using fairly straightforward rolling techniques and selecting appropriate profiles for the die teeth. The depth of rolling can also be adjusted by means of the stop mechanism 14, and this too will be a controlling factor in the process. Further, in accordance with the invention different die teeth profiles can be used either separately or simultaneously on the same blank to achieve the required densification and in this context it should be noted that different degrees of densification of the blank may be desired in different regions depending upon the eventual use of the manufactured gear. Densification at the root is desirable to enhance the bending strength; ie, prevent the teeth from breaking away from the body of the gear. Densification along the flank is desirable for wear resistance.

The above discussion refers essentially to the formation of spur gears from powder metal blanks. However, it will readily be recognised that exactly the same techniques and variations can be adopted in the manufacture of helical gears. The present invention is equally applicable to both.

We claim:

1. A gear wheel formed from a pressed and sintered toothed metal powder blank, wherein the metal powder comprises an admixture of iron powder and at least one alloying addition, and the toothed blank is surface hardened by applying densifying pressure to the surfaces of at least the tooth root and flank regions to establish densification in the range of 90 to 100 percent of full theoretical density to a depth of at least 380 microns and up to 1,000 microns.

2. A gear wheel according to claim 1 wherein the density at the surfaces of the hardened regions of the wheel is substantially 100 percent of full theoretical density.

3. A gear wheel according to claim 2 wherein the metal density reduces with increasing depth beneath the surfaces of the hardened regions.

4. A gear wheel according to claim 3 wherein the rate of density reduction is lower at said surfaces, and increases with increasing depth beneath the hardened regions.

5. A gear wheel according to claim 1 wherein the surfaces to which said surface hardening pressure is applied consist of surfaces of the tooth root and flank regions.

6. A gear wheel according to claim 1 wherein the metal density reduces with increasing depth beneath the surfaces of the hardened regions.

7. A gear wheel according to claim 6 wherein the rate of density reduction is lower at said surfaces, and increases with increasing depth beneath the hardened regions.

8. A gear wheel according to claim 1, 2, 6, 3, 7 or 4 wherein said at least one alloying addition is selected from among Chromium and Manganese.

9. A gear wheel according to claim 1, 2, 6, 3, 7 or 4 wherein said at least one alloying addition is selected from among Carbon, Molybdenum, Nickel, Copper and Vanadium.

10. A gear wheel according to claim 1, 2, 6, 3, 7 or 4 wherein the particle size of said alloying addition is in the range 2 to 10 microns.

11. A gear wheel according to claim 8 wherein the particle size of said alloying addition is in the range 2 to 10 microns.

12. A gear wheel according to claim 9 wherein the particle size of said alloying addition is in the range 2 to 10 microns.

13. A gear wheel formed from a pressed and sintered toothed metal powder blank, wherein the metal powder comprises an admixture of iron powder and at least one alloying addition, and the toothed blank is surface hardened by applying densifying pressure primarily to the surfaces of the tooth root and flank regions to establish densification of 90 to 100 percent of full theoretical density to a depth of at least 380 microns and up to 1,000 microns beneath the surfaces of said regions, the metal density of the wheel: (a) being substantially 100 percent of full theoretical density at said surfaces, (b) reducing with increasing depth beneath said surfaces in the hardened regions, and (c) reducing at a rate which is lower at said surfaces and increases with increasing depth in the hardened regions.

14. A gear wheel according to claim 13 wherein the particle size of said alloying addition is in the range 2 to 10 microns.

15. A gear wheel according to claim 13 or 14 wherein said at least one alloying addition is selected from among Chromium and Manganese.

16. A gear wheel according to claim 13 or 14 wherein said at least one alloying addition is selected from among Carbon, Molybdenum, Nickel, Copper and Vanadium.

17. A method of making a gear wheel comprising:

forming a pressed and sintered toothed metal powder blank wherein the metal powder comprises an admixture of iron powder and at least one alloying addition; and surface hardening the toothed blank by applying densifying pressure to the surfaces of at least the tooth root and flank regions to establish densification in the range of 90 to 100 percent of full theoretical density to a depth of at least 380 microns and up to 1,000 microns.

18. A method of making a gear wheel comprising:

forming a pressed and sintered toothed metal powder blank wherein the metal powder comprises an admixture of iron powder and at least one alloying addition; and surface hardening the toothed blank by applying densifying pressure primarily to the surfaces of the tooth root and flank regions to establish densification of 90 to 100 percent of full theoretical density to a depth of at least 380 microns and up to 1,000 microns beneath the surfaces of said regions, wherein the surfaces of said regions of the wheel are densified to substantially 100 percent of full theoretical density, the metal density is reduced with increasing depth from said surfaces of the hardened regions and the rate of such reduction relative to depth is made to be lower at said surfaces and to increase with increasing depth in the hardened regions.

19. A method of manufacturing a gear wheel by advancing a gear rolling die to rotatably mesh with said gear wheel, said gear rolling die having an axis of rotation substantially parallel to the axis of rotation of said gear wheel, comprising progressively applying said gear rolling die radially against the tooth root and flank regions of a pressed and sintered powder metal blank to establish densification in the range of 90 to 100 percent of full theoretical density to a depth of at least 380 and up to 1,000 microns in said regions.

20. A method according to claim 19 wherein said regions are compacted by substantially 120 microns during said rolling.

21. A method according to claim 17, 18 or 19 wherein said alloying addition is selected from among ferro chromium, ferro molybdenum and ferro manganese.

22. A method according to claim 17, 18 or 19 wherein densifying pressure is applied to the surfaces of regions which consist of the tooth root and flank regions.

* * * * *